US010107016B2

(12) United States Patent
Dikici et al.

(10) Patent No.: US 10,107,016 B2
(45) Date of Patent: Oct. 23, 2018

(54) LOCKING DEVICE FOR A DOOR OR FLAP

(71) Applicant: Volkswagen Aktiengesellschaft, Wolfsburg (DE)

(72) Inventors: Uelker Dikici, Langenhagen (DE); Andreas Sukop, Edemissen-Moedesse (DE); Joerg Havemann, Bad Bodenteich (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 15/148,560

(22) Filed: May 6, 2016

(65) Prior Publication Data

US 2016/0251878 A1 Sep. 1, 2016

Related U.S. Application Data

(63) Continuation of application No. PCT/EP2014/073583, filed on Nov. 3, 2014.

(30) Foreign Application Priority Data

Nov. 6, 2013 (DE) ..... 10 2013 222 465

(51) Int. Cl.
*E05B 79/04* (2014.01)
*E05B 9/08* (2006.01)
(Continued)

(52) U.S. Cl.
CPC ..... *E05B 79/04* (2013.01); *E05B 9/082* (2013.01); *E05B 9/084* (2013.01); *E05B 79/02* (2013.01); *E05B 83/36* (2013.01); *E05B 85/06* (2013.01)

(58) Field of Classification Search
CPC . E05B 9/08; E05B 9/082; E05B 9/084; E05B 79/00; E05B 79/02; E05B 79/04;
(Continued)

(56) References Cited

U.S. PATENT DOCUMENTS 1,636,364 A * 7/1927 Hoegger ..... A47K 10/10
16/DIG. 24
3,537,736 A * 11/1970 Kroopp ..... E04B 1/5831
403/171

(Continued)

FOREIGN PATENT DOCUMENTS

CN 1496898 A 5/2004
CN 1555452 A 12/2004

(Continued)

*Primary Examiner* — Christopher J Boswell
(74) *Attorney, Agent, or Firm* — Muncy, Geissler, Olds & Lowe, P.C.

(57) ABSTRACT

A locking device for a door or flap having a cylinder lock that has a cylinder bush and a cylinder core rotatably supported in the cylinder bush. A bearing bracket is fastenable to the door or flap and has a receptacle for the cylinder lock. A screw is also provided that establishes a mechanical connection of the cylinder bush to a trim element for the door or flap. The screw interacts with a threaded hole of a bow element in order to move the bow element. The cylinder bush has a radial recess, which forms a pressure tip at the end of the screw facing the cylinder bush, which pressure tip, while inserted in the radial recess, interacts with the pressure surface in order to axially and radially support the screw.

10 Claims, 2 Drawing Sheets

(51) Int. Cl.
*E05B 83/36* (2014.01)
*E05B 79/02* (2014.01)
*E05B 85/06* (2014.01)

(58) Field of Classification Search
CPC ..... E05B 79/08; E05B 83/36; E05B 85/02; E05B 85/06; E05B 85/10
See application file for complete search history.

(56) References Cited

U.S. PATENT DOCUMENTS 3,605,242 A * 9/1971 Kuffner ..... B25B 27/062 29/259
4,883,296 A * 11/1989 Laurie ..... E05B 9/082 292/336.3
5,228,798 A * 7/1993 Tzanovici ..... E05B 1/0015 292/350
6,401,302 B1 6/2002 Josserand et al.
6,523,871 B1 * 2/2003 Josserand ..... E05B 79/06 292/347
6,834,901 B2 12/2004 Löw
6,960,045 B2 * 11/2005 Schmalzhofer ..... F16B 7/187 403/188
7,854,153 B2 12/2010 Lennhoff et al.
8,104,314 B2 * 1/2012 Mueller ..... E05B 9/084 70/208
8,746,758 B2 * 6/2014 Savant ..... E05B 77/06 292/336.3
8,959,964 B2 * 2/2015 Hidaka ..... E05B 79/06 292/336.3
8,992,114 B2 * 3/2015 Ajanovic ..... F16B 12/2063 403/231
9,228,380 B2 * 1/2016 Gerber ..... E05B 79/06
9,307,797 B2 * 4/2016 Sanchez Giraldez ... A41F 1/002
9,576,507 B2 * 2/2017 Helmholz ..... G09F 1/10
9,732,781 B2 * 8/2017 Ajanovic ..... F16B 12/2063
2002/0104343 A1 * 8/2002 Schwab ..... E05B 79/06 70/237
2004/0125545 A1 7/2004 Kobayashi et al.
2008/0185850 A1 * 8/2008 Takaya ..... E05B 79/04 292/336.3
2014/0023452 A1 * 1/2014 Maloney ..... F16B 39/284 411/166
2015/0071730 A1 * 3/2015 Tseng ..... F16B 5/0208 411/318

FOREIGN PATENT DOCUMENTS

DE 36 06 347 C1 2/1987
DE 41 26 714 C1 9/1992
DE 200 16 108 U1 2/2001
DE 100 36 398 A1 2/2002
DE 101 46 026 C1 10/2002
DE 10 2004 012 456 A1 9/2005
DE 10 2005 042 350 A1 3/2007
DE 601 25 748 T2 11/2007
DE 10 2011 108 891 A1 1/2013
EP 0 68 075 B1 6/1999
EP 1 026 349 A1 8/2000
JP 2003-239579 A 8/2003
JP 3723621 B2 12/2005
WO WO 2013/013751 A1 1/2013

* cited by examiner

LOCKING DEVICE FOR A DOOR OR FLAP

This nonprovisional application is a continuation of International Application No. PCT/EP2014/073583, which was filed on Nov. 3, 2014, and which claims priority to German Patent Application No. 10 2013 222 465.6, which was filed in Germany on Nov. 6, 2013, and which are both herein incorporated by reference.

BACKGROUND OF THE INVENTION

Field of the Invention

The invention relates to a locking device for a door or flap, in particular of a vehicle, for example, a motor vehicle, with a cylinder lock that has a cylinder bushing and has a cylinder core that is rotatably supported in the cylinder bushing, with a bearing bracket that can be fastened or is fastened to the door or flap and has a receptacle for the cylinder lock, and with a screw that establishes a mechanical connection of the cylinder bushing to a trim element for the door or flap.

Description of the Background Art

Locking devices of the aforementioned type are known from the prior art, for example from DE 10 2004 012 456 A1. During the course of further development of motor vehicles, development of measures for improving protection from theft or break-ins of vehicles has also taken place. In addition to electronic measures such as, e.g., immobilizers, mechanical devices are also used in this context. Locking devices that include a cylinder lock located in a door or flap of the vehicle are customary as mechanical security devices. As the primary component, the cylinder lock has a cylinder bushing, in particular a stationary cylinder bushing, that is attached to the bearing bracket and in which a cylinder core is rotatably supported. As a result of the rotation of the cylinder core, which can only be initiated with a matching key inserted into the core, the rotary motion is transmitted to a locking mechanism of the locking device, by which means the opening of the flap or door is ultimately accomplished. The cylinder lock in this design is typically held in a bearing bracket that is attached to the interior of the door or flap or on its inner side.

It is also known from DE 10 2004 012 456 A1 to provide a screw that establishes a mechanical connection of the cylinder bushing to a trim element of the door or flap. To this end, the screw is inserted from the outside in sections, through the trim panel and through the bearing bracket, into a radial recess of the cylinder bushing. The tip of the screw enclosed in the radial recess ensures that the cylinder bushing catches on the trim panel and cannot be pulled out in the event of violent destruction of its attachment.

Thus, in addition to the actual attachment of the cylinder bushing in the bearing bracket, the screw is provided that only performs its function in the event of violent forcible opening. As a result of the plurality of individual parts, a comparatively large installation space is required, and commensurately high production and installation costs ensue as well.

SUMMARY OF THE INVENTION

It is therefore an object of the invention to provide a locking device that is designed to be more economical and more space-saving without sacrificing security against forcible opening in the process.

The object that is the basis of the invention is attained by a locking device that has the advantage that a single screw is provided both for attachment of the cylinder bushing in the bearing bracket and for securing to the trim element, this single screw taking on the function of attachment in addition to the function of securing. As a result, it is possible to save component costs, shorten assembly time, simplify assembly, and save installation space, with the security of the locking device against violent forcible opening remaining at least as good. Preferably, the trim element is a metal trim panel, especially preferably an inner panel of the door or flap. The trim element represents a component of the locking device in this case.

The locking device according to an embodiment of the invention provides a bracket element that radially surrounds the cylinder bushing at least in part and is movably supported on the bearing bracket and that has at least one engagement for engaging a recess of the cylinder bushing, and in that the screw interacts with a threaded bore of the bracket element for the displacement thereof, wherein the cylinder bushing has a radial indentation that forms a pressure surface, and wherein the screw has a pressure tip at its end facing the cylinder bushing that is introduced into the radial indentation and interacts with the pressure surface to axially and radially support the screw. The locking device thus has only the one screw for attachment and securing of the cylinder lock or cylinder bushing. The screw is passed through a thread of the bracket element or through the threaded bore. The screw can be axially displaced relative to the bracket element by means of a rotation. If the screw is screwed far enough into the threaded bore that its pressure tip contacts the radial indentation or the pressure surface of the radial indentation, then an axial force is produced that forces the section of the bracket element having the threaded hole away from the cylinder bushing. As a result, screwing in the screw makes it possible to displace the bracket element in the manner of a spindle and to bring the at least one engagement into engagement with the recess of the cylinder bushing in order to fasten the latter in the bearing bracket. Since the screw simultaneously establishes the mechanical connection to the trim element, the screw fulfills both of the abovementioned functions. For attachment, the screw braces against the cylinder bushing to displace the bracket element, and at the same time is in mechanical connection with the trim element in order to ensure the described catching in the event of a violent forcible opening of the locking device. The screw is thus the sole screw for attachment and for securing of the locking device or the cylinder lock.

According to an embodiment of the invention, provision is made that the bracket element is at least substantially annular in design and completely surrounds the cylinder bushing radially. The bracket element thus completely encloses the cylinder bushing and has especially great stability against forcible mechanical opening because of the continuous annular shape. This further improves security against unauthorized opening of the door or flap.

In addition, provision is made that the bracket element can have a cross-rib as an engagement on the side opposite the threaded bore. The cross-rib connects the free ends of two parallel legs of the bracket element that are spaced apart from one another, thus producing the closed ring shape and ensuring great resistance to forced entry. Because the cross-rib itself forms the engagement, no further provisions are necessary on the bracket element, as for example radially inward-facing engagement projections, so the bracket element can be produced especially economically and simply. However, provision can of course also be made according to another embodiment that one or more projections that face radially inward or toward the cylinder bushing and that engage corresponding receptacles are provided on the cross-rib.

The cylinder bushing can have the recess for accepting the engagement on its side opposite the radial indentation. In this way, the recess of the cylinder bushing is associated with the engagement of the bracket element that is located on the side opposite the threaded bore. On the one hand, this prevents incorrect assembly, and on the other hand the introduction of the engagement into the recess is optimally facilitated by the support of the screw on the pressure surface of the cylinder bushing.

The recess can be implemented as a receiving groove in the cylinder bushing. As a result, an especially wide engagement can engage in the recess, thus increasing the positive engagement and improving security against forcible opening. In useful fashion, the legs, which lead from the cross-rib to the section of the bracket element having the threaded bore, are so distant from one another that the cylinder bushing can be passed between them. Due to the subsequent displacement of the striker, the striker achieves engagement with the recess and locks the cylinder bushing by positive locking in the axial direction. The cross-rib and/or the receiving groove can each have at least one lead-in chamfer that ensures reliable placement of the bracket element in the recess of the cylinder bushing as well as automatic centering of the cylinder bushing.

According to an embodiment of the invention, the bearing bracket can have a slide guide for locating the bracket element in such a manner as to be displaceable primarily only radially with respect to the cylinder bushing. The primarily only radial displaceability of the bracket element ensures that the bracket element or the cylinder bushing is held axially on the bearing bracket with only very little play, preferably with no play or clearance-free. The axial support of the bracket element thus takes place on the bearing bracket itself.

The radial indentation can be conical in design, wherein the pressure tip of the screw is designed to be complementary to the pressure surface. This achieves the result that full-area contact of the pressure tip in the radial indentation or on the pressure surface is ensured for advantageous force transmission. Because of the conical design, moreover, automatic centering of the screw, or of its pressure tip, is achieved, wherein it is possible when in the screwed-in state or in the state inserted in the radial indentation for forces to also be transmitted to the bracket element, and vice versa, radially with respect to the screw.

According to an embodiment, the bracket element can have a first section surrounding the cylinder bushing and a second section having the threaded bore, wherein the two sections are designed to be at least essentially perpendicular to one another. Especially when the bracket element is designed as a bent sheet metal part, this achieves the result that the section surrounding the cylinder bushing can be made relatively shallow, in particular more shallow than the diameter of the screw, and that the threaded bore can be made in a simple manner in the section perpendicular thereto. As a result, the already mentioned design of the bracket element as a bent sheet metal part can also be implemented in a simple and economical manner.

In addition, the trim element can have an opening through which the end of the screw opposite the pressure tip is passed. By this means, the catching of the cylinder bushing on the trim element in the event of violent forcible opening of the locking device is ensured in a simple manner. Preferably the diameter of the invention corresponds nearly to the diameter of a threaded shank of the screw in order to ensure reliable catching.

According to an embodiment, the screw can have a screw head whose diameter is larger than the diameter of the opening of the trim element, wherein the screw head rests on the side of the trim element opposite the bracket element, so that the screw head, by positive engagement, advantageously provides additional securing against unauthorized forcible opening of the locking device.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
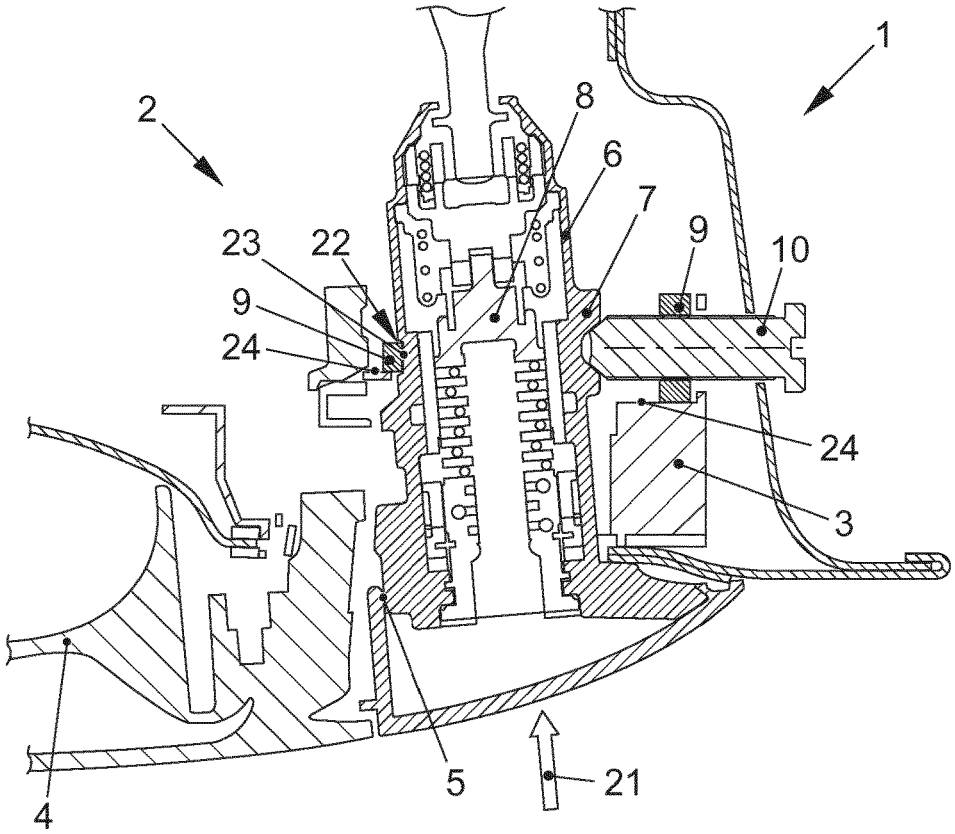
FIG. 1 shows a locking device of a door of a motor vehicle.

FIG. 1 shows a cross-sectional view of sections of a door 1 of a motor vehicle that is not shown in detail, which door has a locking device 2. Fixed in place on the door 1 is a bearing bracket 3 of the locking device 2, which bracket also carries a door handle that can be operated. The bearing bracket 3 also has a receptacle 5 in which a cylinder lock 6 is located.

The cylinder lock 6 has a cylinder bushing 7 and a cylinder core 8 that is rotatably supported in the cylinder bushing. The rotation of the cylinder core 8 can only be initiated with a matching key inserted into the core. The basic design of a cylinder lock is known from the prior art and thus will not be explained in detail here. The cylinder bushing 7 is inserted axially into the receptacle 5, and is held by at least radial positive engagement with the receptacle 5.

Also associated with the cylinder lock 6 is a bracket element 9, which serves the purpose of axial guidance of the cylinder bushing 7 and thus of the cylinder lock 6 in the receptacle 5 or on the bearing bracket 3. In addition, the locking device 2 has a screw 10 that interacts with the bracket element 9 as described below.

Figure 2:
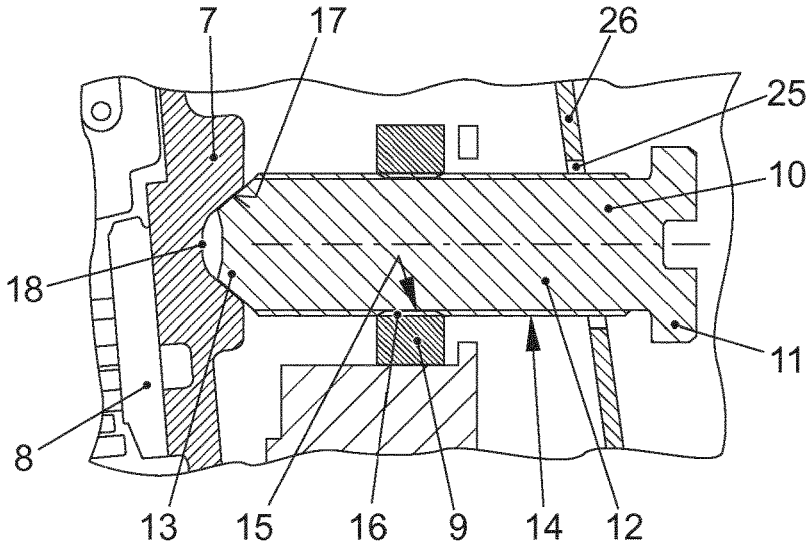
FIG. 2 shows an enlarged detail view of the locking device.

To this end, FIG. 2 shows an enlarged detail view of the locking device 2 in another cross-sectional representation. At one end, the screw has a screw head 11 that is adjoined by a threaded shank 12, which at the other end terminates in a pressure tip 13. The threaded shank 12 has an external thread 14 that interacts with an internal thread 15 of a threaded bore 16 of the bracket element 9. The pressure tip 13 has a conical contour, and is designed to interact with pressure surface 17 formed by a radial indentation 18 in the cylinder bushing 7. The pressure surface 17 has a conicity complementary to the pressure tip 13 so that the pressure tip 13 makes full-area contact with the pressure surface 17 so that forces can be transmitted both axially and radially with respect to the screw 10.

Figure 3:
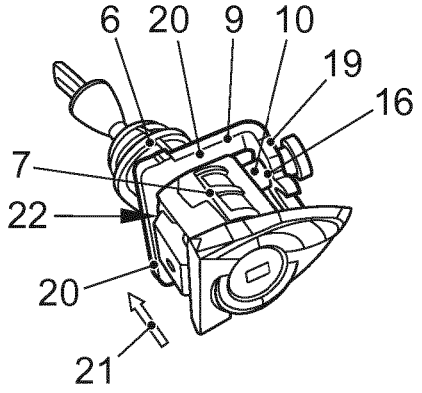
FIG. 3 shows a perspective view of a cylinder lock and of a bracket element of the locking device.

FIG. 3 shows the cylinder lock 6 together with the bracket element 9 and the screw 10 in a perspective view. It can be seen there that the bracket element 9 has a first section 19 that includes the threaded bore 16 for the screw 10, and a second section 20 that radially surrounds the cylinder bushing 7 of the cylinder lock 6.

Figure 4:
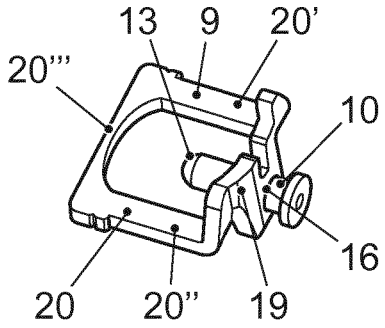
FIG. 4 shows a perspective view of the bracket element.

To this end, FIG. 4 shows the bracket element 9 together with the screw 10 in another perspective view, where it can be seen that the bracket element 9 is essentially annular in design with a rectangular contour. As a result of this ring shape, the bracket element 9 has, in the section 20, starting from the section 19, two mutually parallel and spaced-apart legs 20' and 20" that are connected to one another at their free ends by a cross-rib 20'". The bracket element 9 is designed as a single piece and especially preferably is produced as a bent sheet metal part. The first section 19 in this design is substantially perpendicular to the second section 20, wherein the threaded bore 16, through which the threaded shank 12 of the screw 10 is passed, is located at the level of the cross-rib 20'" so that the axis of rotation of the screw 10 lies in the plane of the section 20, with the pressure tip 13 of the screw 10 oriented such that it points toward the cross-rib 20'". The two legs 20' and 20", and the cross-rib 20'" and the section 19, are each located sufficiently distant from one another in forming an opening of the bracket element that the cylinder bushing 7 can be pushed through, or into, the opening of the bracket element 9 as indicated by arrow 21 in FIG. 3.

On its side opposite the radial indentation 18, the cylinder bushing 7 has a recess 22 in the form of a receiving groove 23, as can best be seen in FIG. 1. The receiving groove 23 has a height or clear opening that corresponds essentially to the height of the cross-rib 20'" so that said cross-rib can be inserted into the receiving groove 23 without play, as shown in FIGS. 1 and 3. The receiving groove 23 preferably extends only across the back, or the side of the cylinder bushing 7 opposite the radial indentation 18, in this design.

Figure 5:
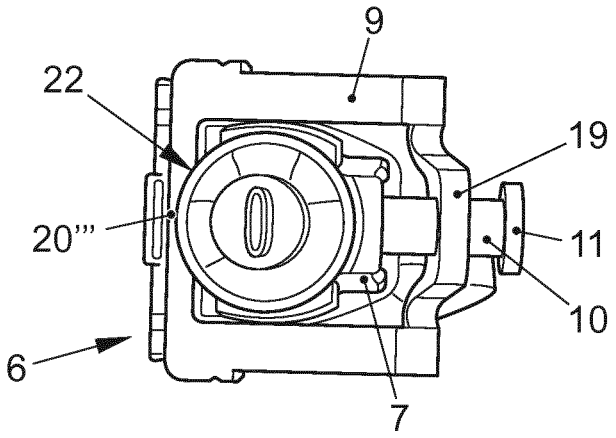
FIG. 5 shows a top view of the arrangement from FIG. 3 to illustrate the mode of operation.

Now the attachment of the cylinder lock 6 to the bearing bracket 3 by means of the bracket element 9 shall be explained on the basis of FIG. 5. FIG. 5 shows a top view of the assembly from FIG. 3 having a cylinder lock 6, bracket element 9, and screw 10, in the fully assembled state. First the bracket element 9 is positioned in the bearing bracket 3. For this purpose, the bearing bracket 3 has a slide guide 24 through which the bracket element 9 is mounted such that it is displaceable radially with respect to the cylinder bushing 7 in the plane of the section 20. Then the cylinder lock 6 is pushed into the receptacle 5 and through the opening in the pre-assembled bracket element 9, in accordance with the arrow 21. Then the screw 10 is actuated, namely such that it is screwed in toward the cross-rib 20". As soon as the pressure tip makes contact with the back surface 17, an axial force is exerted that causes the bracket element 9 to be pulled in the manner of a spindle toward the screw head 11 on the threaded shank 12. As a result, the cross-rib 20'" is pushed into the receiving groove 23 of the cylinder bushing 7. Preferably, the cross-rib 20'" is pulled all the way in to the receiving groove 23 so that it essentially fills the receiving groove 23 completely. Doing so brings about a positive engagement between bracket element 9 and cylinder bushing 7—in the axial direction when viewed with respect to the cylinder bushing 7—which reliably prevents the cylinder lock 6 from being simply pulled out of the receptacle 5 of the bearing bracket 3. By this means, the cylinder lock 6 is attached to the bearing bracket 3, or the door 1, in a simple way.

As is evident from FIGS. 1 and 2, provision is additionally made that the threaded shank 12 of the screw 10 is passed through an opening 25 in a trim element 26 of the door 1, which in particular is implemented as an inner panel, so that the screw head 11 is located outside of the trim element 26, while the rest of the locking device 2 is located inside the trim element 26. The screw head 11 has an outer diameter that is larger than the opening 25. During assembly, the screw 10 is thus supplied from outside through the opening 25 in the trim element 26 of the threaded bore 16 of the bracket element 9. The locking device 2 is designed such that the screw head 11 is even located outside the trim element 26 when the screw 10 has been screwed to the maximum extent into the threaded bore 16. As a result, in addition to attachment of the cylinder lock 6 to the bearing bracket 3, additional securing against unauthorized opening of the door is ensured. If the cylinder lock 6 were pulled out of the receptacle 5 by the application of force, then the radial transmission of force to the screw 10 by the conical pressure surface would cause the cylinder bushing 7 or the cylinder lock 6 to catch on the trim element 26 because of the mechanical connection with the trim element 26. As a result, simple removal of the cylinder lock 6 from the bearing bracket 3 is prevented even if the attachment of the cylinder lock 6 has been forcibly opened.

The screw 10 thus fulfills two functions at once, firstly attachment of the cylinder lock 6 and secondly securing of the cylinder lock 6 in the event of forcible opening of the locking device 2.

While the present exemplary embodiment relates to a vehicle door, provision can be made according to another exemplary embodiment for the described locking device 2 to be located on a vehicle flap such as, e.g., a trunk lid or the like.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A locking device for a door or flap of a vehicle, the locking device comprising:

a cylinder lock that has a cylinder bushing and has a cylinder core that is rotatably supported in the cylinder bushing;

a bearing bracket fastenable to the door or flap and has a receptacle for the cylinder lock;

a screw that establishes a mechanical connection of the cylinder bushing to a trim element, wherein the trim element is an inner door panel; and a bracket element that radially surrounds the cylinder bushing at least in part and is movably supported on the bearing bracket and has at least one engagement for engaging a recess of the cylinder bushing, wherein the screw interacts with a threaded bore of the bracket element for the displacement thereof, wherein the cylinder bushing has a radial indentation that forms a pressure surface, wherein the screw has a pressure tip at an end facing the cylinder bushing that, when introduced into the radial indentation, interacts with the pressure surface to axially and radially support the screw, wherein the pressure surface of the radial indentation is conical in design, wherein the pressure tip of the screw is complementary to the pressure surface, wherein the trim element has an opening through which the screw is passed, and wherein the screw has a screw head whose diameter is larger than a diameter of the opening of the trim element, such that the screw head engages with the trim element.

2. The locking device according to claim 1, wherein the bracket element is at least substantially annular in design and completely surrounds the cylinder bushing radially.

3. The locking device according to claim 1, wherein the bracket element has a cross-rib as the engagement on the side opposite the threaded bore.

4. The locking device according to claim 1, wherein the cylinder bushing has the recess on its side opposite the radial indentation.

5. The locking device according to claim 1, wherein the recess is a receiving groove in the cylinder bushing.

6. The locking device according to claim 1, wherein the bracket element has a first section surrounding the cylinder bushing and a second section having the threaded bore, and wherein the two sections are substantially perpendicular to one another.

7. The locking device according to claim 1, wherein the bearing bracket has a slide guide for locating the bracket element to be displaceable primarily only radially with respect to the cylinder bushing.

8. The locking device according to claim 1, wherein the screw head directly contacts an outer surface of the trim element to positively engage with the trim element when the pressure tip of the screw interacts with the pressure surface of the radial indentation of the cylinder bushing.

9. The locking device according to claim 1, wherein the bracket element is annular such that it extends continuously around an outer surface of the cylinder bushing.

10. The locking device according to claim 1, wherein, in a fully assembled state of the locking device, the trim element is discrete from and spaced apart from the bracket element and the bearing bracket, such that any contact between the trim element and the bracket element and between the trim element and the bearing bracket is an indirect contact.

* * * * *